US005263647A

United States Patent [19]

Cerny et al.

[11] Patent Number: 5,263,647

[45] Date of Patent: Nov. 23, 1993

[54] ELECTROMAGNETIC COIL FOR A FUEL INJECTOR

[75] Inventors: Mark S. Cerny, Sterling Hgts.; James F. Prestel, Rochester, both of Mich.

[73] Assignee: Chrysler Corporation, Highland Park, Mich.

[21] Appl. No.: 993,204

[22] Filed: Dec. 18, 1992

[51] Int. Cl.[5] ..... F02M 51/06

[52] U.S. Cl. ..... 239/585.1; 239/DIG. 4; 239/DIG. 19; 251/129.15; 335/260

[58] Field of Search ..... 239/585.1, 585.4, 585.5, 239/DIG. 4, DIG. 19; 251/129.15; 335/260

[56] References Cited

U.S. PATENT DOCUMENTS 4,423,841 1/1984 Palma ..... 251/129.15 X 4,851,878 8/1990 Casey et al. ..... 239/DIG. 19 X 4,988,073 1/1991 Cristiani ..... 251/129.15 X 5,188,297 2/1993 Asano ..... 239/DIG. 4 X

*Primary Examiner*—Andres Kashnikow

*Assistant Examiner*—William Grant

*Attorney, Agent, or Firm*—Kenneth H. MacLean

[57] ABSTRACT

An improved electromagnetic actuator assembly with a fuel compatible bobbin part insertably supported in a recess of an engine fuel injector housing and sealed to prevent fuel leakage and any contact of fuel with the remaining portions of the actuator assembly. Resultantly, only the bobbin part is exposed to fuel and needs to be of costly fuel compatible material. The remainder of the actuator parts can be formed of more easily formed and less stable elastomeric material.

10 Claims, 2 Drawing Sheets

ELECTROMAGNETIC COIL FOR A FUEL INJECTOR

BACKGROUND OF THE INVENTION

1. Field of the Invention

The subject application concerns an improved electromagnetic actuator or coil assembly for a fuel injector of an internal combustion engine. The improved actuator assembly is a dry coil type in which the actuator's electrical parts are isolated from contact with fuel. Specifically, a bobbin part of the actuator is made of fuel compatible material and is configured to be closely received in a recess defined by the associated fuel injector housing. Seal between the bobbin and the housing prevent passage of fuel to electrical components of the actuator.

2. Description of Related Art

In the engine fuel injection art, it is known to use an electromagnetic actuator for operating a valving device. However, a typical prior fuel injector provides a wet actuator type design in which the entire electromagnetic actuator is exposed to fuel. This design necessitates that the entire actuator structure be able to withstand exposure to fuels such as gasoline, methanol and other alcohols. Resultantly, expensive and sometimes hard to work with materials must be employed to withstand long term exposure to fuels. Also, special wire coating for the coil must protect the wire and small seals are employed to seal the joint between the terminals and the structure. Therefore, a dry type injector design would be highly desirable. In a dry type, the parts of the actuator, particularly electrical parts, are not contacted by fuel.

SUMMARY OF THE INVENTION

As mentioned, a dry type design does not require special wire material or coatings. Nor does it require use of expensive material for all components but only those exposed to the fuel. The previously necessitated small O-rings or seals for terminals are eliminated. Although larger O-rings are quite satisfactory for sealing, such small O-rings are not desirable as they have a relatively small cross section and small sealing area with the associated parts and are prone to leakage.

An objective of the subject improved electromagnetic actuator for a fuel injector is to provide a dry type design requiring only one part of the actuator to be of expensive fuel compatible material.

A further objective of the subject improved electromagnetic actuator for a fuel injector is to provide a dry type design eliminating use of small O-rings for sealing terminals.

Another objective of the subject improved electromagnetic actuator for a fuel injector is to provide a dry type design adapted to withstand high internal fuel pressures and temperatures without internal or external leakage or distortion.

Further advantages of the subject improved electromagnetic actuator will be apparent by reference to the following detailed description of an embodiment, reference being to the drawings of a preferred embodiment.

IN THE DRAWINGS

FIG. 1 is an elevational and sectioned view of a fuel injector supported by an associated engine cylinder head and including the subject improved electromagnetic coil assembly; and FIG. 2 is a perspective view of a support base part of the subject improved electromagnetic coil subassembly; and FIG. 3 is a perspective view similar to FIG. 2 with a wire coil and terminals added; and FIG. 4 is an elevational and sectioned view of the improved electromagnetic coil subassembly within a mold used to add the final portion of the coil assembly.

DETAILED DESCRIPTION OF A PREFERRED EMBODIMENT

The Fuel Injector

Figure 1:
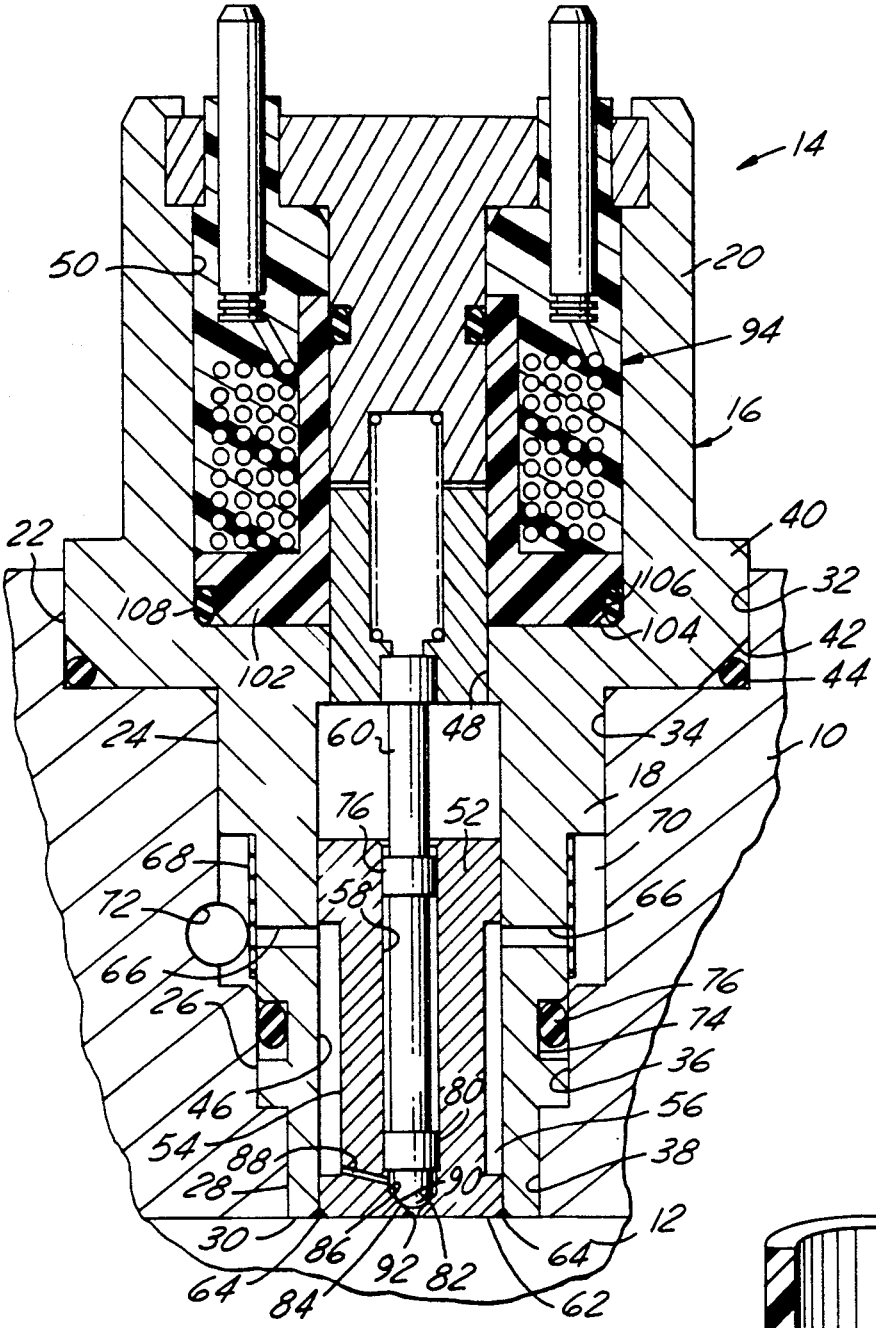

In FIG. 1, a portion of an engine cylinder head 10 is shown which partially defines a combustion chamber 12. A fuel injector 14 is supported by the cylinder head 10 and includes a generally tubular housing 16. Housing 16 has a lower portion 18 and an upper portion 20. The lower portion 18 has a step configured outer surface consisting of variously sized cylindrical portions 22, 24, 26, 28 and a lower end surface 30.

A step configured aperture extends through the cylinder head 10 and has coaxial bores 32, 34, 36, and 38. The step configured lower housing portion 18 of injector 14 is received within the similarly configured step bores 32, 34, 36, and 38. A midportion of housing 16 has a radially enlarged annular portion 40 with outer surface 22 which is received into an enlarged recess in the cylinder head formed by bore 32. Portion 40 has a beveled lower corner 42 which coacts with corner walls of the recess to form a pocket or cavity for an O-ring seal member 44 which inhibits leakage of combustion gases between the cylinder head 10 and the fuel injector housing 16.

The tubular housing 16 has coaxial bores 46, 48 and 50 therein. Bore 46, adjacent end surface 30, supports a tubular and generally cylindrical valve guide member 52 therein. A channel 54 formed in the midportion of the member 52 cooperates with bore 46 to form a chamber 56. Guide member 52 defines a central bore 58 which receives an elongated valve element 60. In a preferred embodiment, the support member 52 is attached and axially fixed to housing 16 by welding an end portion 62 as indicated by numeral 64 to seal the joint between members 16 and 52.

The chamber 56 receives pressurized fuel through radial inlet passages 66 which extend through the lower housing portion 18. A filter or screen member 68 extends about the lower portion 18 and over passages 54 to prevent particles from entering the interior of the injector. Pressurized fuel is provided to inlet passages 66 and chamber 56 from a annular chamber 70 formed between the lower housing portion 18 and cylinder head 10. Fuel flows to annular chamber 70 from a passage 72 which is formed longitudinally through cylinder head 10. A groove or channel 74 in the lower housing portion 18 supports an O-ring type seal 76 to prevent leakage of the pressurized fuel from chamber 70 between the injector housing 16 and cylinder head 10.

In FIG. 1, the valve member 60 is shown with a pair of axially spaced and radially enlarged portions 78, 80 which are closely sized relative to the bore 58 to permit axial reciprocal movements of the valve 60 in the bore 58 while inhibiting fuel leakage. Valve member 60 has a cylindrical lower portion 82 terminating with a semispherically shaped lower end surface 84. The lower portion 82 is slightly smaller in diameter than the surrounding bore 86 to form a narrow chamber therebetween. Fuel is supplied to the narrow chamber through at least one passage 88 in valve member 60. When the valve 60 is in its closed operative position shown in FIG. 1, the end surface 84 seats against a valve seat surface 90 which is formed by and in member 52. When the end portion 82 is moved upward away from seat surface 90, fuel is discharged through a small outlet orifice or port 92 into combustion chamber 12.

The valve 60 is permitted to move in an axial direction between the closed position shown in FIG. 1 and an opened operative position described above. The quantity of fuel allowed to pass through orifice 92 is dependent on the period of time which the valve is maintained open for each combustion event. This open time is controlled by electronic and electrical components. An improved electromagnetic actuator subassembly 94 is utilized to selectively open the valve 60 in response to energization by electronic control means (not shown).

The Improved Electromagnetic Actuator

A wet coil type electromagnetic actuator design is used in many prior fuel injectors. The disadvantages of a wet design and the advantages of the dry design have been described earlier. In the subject improved dry actuator, electrical portions of the actuator are isolated by seals from fuel contact. In one anticipated use of the subject injector, the fuel pressure can be as high as 2,500 psi and temperatures of the injector may reach 300 degrees F. A primary object of this design is to use high strength, high temperature resistant, and expensive fuel compatible elastomeric material only where necessary and needed. In the dry areas of the fuel injector, less expensive and easily molded elastomeric materials are employed adjacent the "dry" electrical parts of the subassembly. The isolation of the electrical portion of the subassembly from fuel also eliminates need for small diameter O-ring seals previously needed to seal terminals for the coil. These small O-rings have a small cross section and minimum sealing contact area and resultantly they are a source of fuel leakage. Seals with a larger diameter and cross section are used in the subject injector design and are much more reliable.

Figure 2:
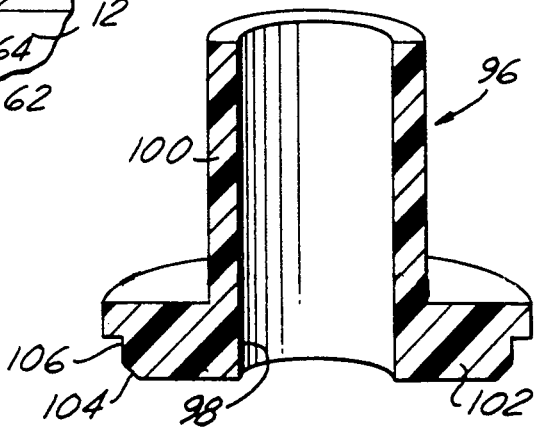

As seen in FIG. 1, the electromagnetic subassembly 94 has a generally cylindrical configuration adapted for insertive mounting within bore 50 of the upper portion 20 of injector housing 16. The subassembly 94 includes a tubular bobbin member 96, as best illustrated in FIG. 2. The bobbin 96 is molded of high strength thermoplastic material such a polyphenaline-sulfide elastomeric material also characterized by high temperature compatibility, stability, flexibility for resistance to cracking. The bobbin 96 is also compatible with both gasoline and methanol. These properties are critical as the bobbin is directly exposed to high magnetic hoop stress, elevated temperatures, and various fuels at relatively high pressures. Also, this material can be molded while retaining these material properties.

The bobbin 96 is mold formed to the shape shown in FIG. 2. The bobbin has a generally cylindrical exterior with an internal bore 98 therethrough defining a tubular upper portion 100. It also has a radially enlarged lower portion 102 defining end surface 102'. The bobbin is formed by molding as opposed to machining from solid stock. This retains desirable physical properties of the material which typically suffers a degradation by machining. The cylindrical shape is relatively easy to mold, even using a hard to mold material. The lower edge portion 102 is molded with the beveled corner 104 to facilitate insertion of the subassembly 94 into the injector housing. A channel 106 is formed adjacent beveled corner 104 which in cooperation with bore 50 in housing 16 defines an annular space for a large O-ring seal 108, shown in FIG. 1.

Figure 3:
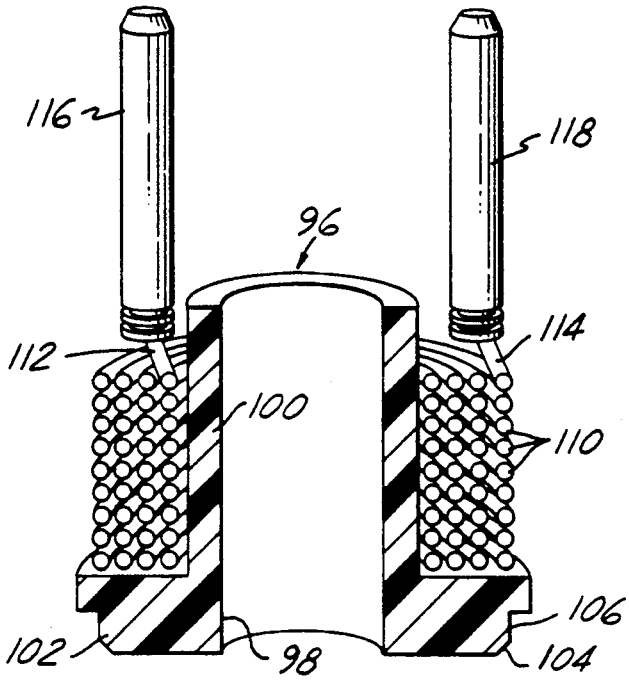

FIG. 3 shows the next step in construction of the actuator 94. In the drawing, the bobbin member 96 is shown with a spiral coil of wire 110 loosely positioned above the radially enlarged end 100 and around the upper end portion 98. Alternately, the wire can be wrapped tightly about the upper portion 100 of the bobbin. Opposite ends 112 and 114 of the wire Coil 110 are connected respectively to electrical terminals 116 and 118.

Figure 4:
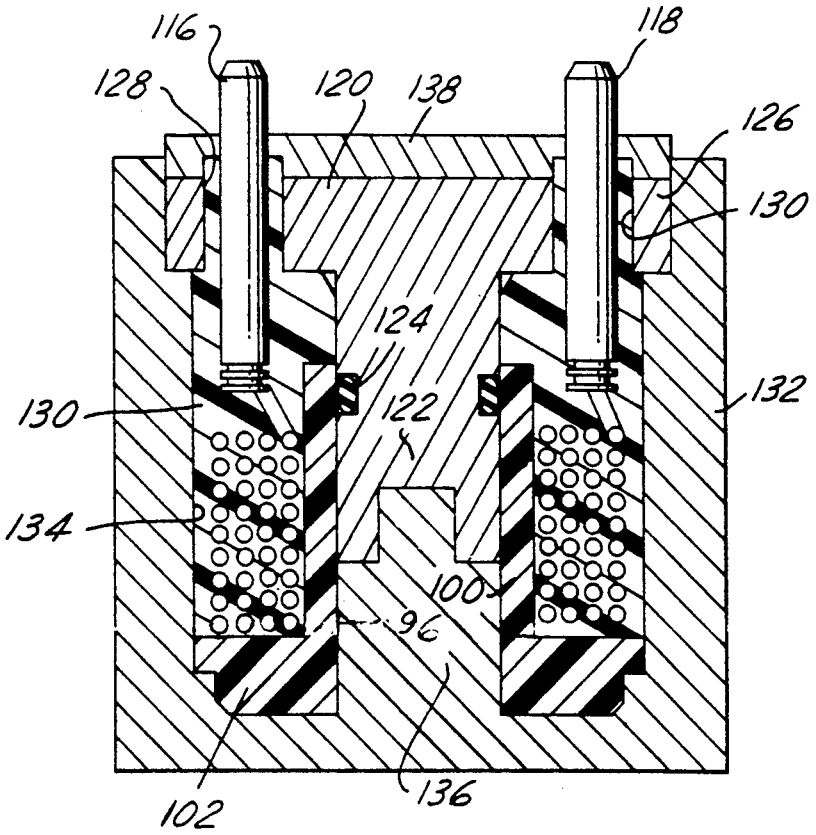

FIG. 4 shows the final steps in construction of the actuator 94. In the drawing, a metal pole piece 120 is mated with the combination of the bobbin member 96, coil 110, and terminals 116 and 118. The pole piece 120 has a central cylindrical body portion 122 which is inserted into the bore 98 of the bobbin 96. A channel about central portion 122 has an O-ring seal 124 to prevent leakage of fluid between the bobbin and pole piece. Further, the pole piece 120 has a radially enlarged upper end portion 126 with openings 128, 130 therethrough. The openings 128, 130 are sized to encircle but not contact terminals 116 and 118.

The coil is insulated from other injector components by an overmolding step shown in FIG. 4. Relatively inexpensive elastomeric material 132 is molded about the bobbin, pole piece, and the coil wires as well as the lower portions of the terminals 116, 118. This material 132 is formed about these components in mold 133 which has an interior cavity 134 to receive the components shown in FIG. 3. The pole piece is then placed over the terminals and against shoulder 133' of the mold. A central upward boss 136 of the mold 133 extends into the bore 98 of the bobbin 96 to center the components in the cavity 134. The pole piece 120 and the upper end of the mold 133 are covered by a second mold part 138. The material 134 is introduced into the cavity 134 to encapsulate the coil wires and lower portions of the terminals. There are several ways known to introduce material 132 into the mold and generally to perform the molding process and consequently exact details are not further described. Also, apparatus to inject the material 132 is not shown. The exact method of molding or the molds themselves are not critical to the invention.

Although only one embodiment has been illustrated and described in detail, it should be understood that modifications are contemplated which fall within the scope of the invention as defined by the following claims.

What is claimed is as follows:

1. An improved electromagnetic actuator assembly for an engine fuel injector with a housing having a recess to receive the actuator assembly, comprising: a bobbin member of elastomeric material with an outer surface, an end surface, and a central aperture; a continuously sound wire coil positioned about said outer surface defining an electrical coil, the wire coil having a pair of ends; a pair of electrical terminals, one connected to one coil end and the other connected to the other coil end; a metallic pole piece member with a central portion extending into the bobbin member central aperture and having a radially outwardly projecting end portion, the projecting end portion having two openings therethrough for passage of the pair of terminals; a molded elastomeric material surrounding the bobbin member outer surface and encapsulating the wire coil and lower portions of the terminals, the outer diameter of the molded elastomeric material and the end surface of the bobbin member being complementary to the fuel injector housing recess, whereby insertive support of the actuator assembly in the fuel injector recess provides a closely fitting relationship between the end surface of the bobbin member with the fuel injector housing to inhibit fuel leakage and therefore contact of fuel with the molded elastomeric material.

2. The improved electromagnetic actuator assembly set forth in claim 1 in which a close fitting relationship between the pole piece member and the bobbin member inhibits fuel leakage and escape of fuel.

3. The improved electromagnetic actuator assembly set forth in claim 1 in which an O-ring seal is located between the central portion of the pole piece member and the bobbin member to seal therebetween.

4. The improved electromagnetic actuator assembly set forth in claim 1 in which an O-ring seal is located between the end surface of the bobbin member and the injector housing to seal therebetween.

5. The improved electromagnetic actuator assembly set forth in claim 1 in which the openings in the pole piece member are sufficiently larger than the outer surface of the terminals to permit a substantial thickness of molded elastomeric material to form therebetween.

6. A fuel injector for an engine having an improved electromagnetic actuator assembly, comprising: an injector housing of generally tubular configuration with an end bore therein defining a shallow recess terminating in a shoulder, the actuator assembly being adapted to be insertably supported in the recess; the actuator assembly including a bobbin member made of elastomeric material which is compatible with fuel; said bobbin member having an inner bore, an outer surface, and a radially extended end portion; a wire coil positioned about the bobbin member outer surface thereby defining an electrical coil; the wire coil having a pair of ends; a pair of electrical terminals, one connected to one end of the coil and the other connected to the other end of the coil; a metallic pole piece member having a central portion extending into the bobbin member inner bore and having a radially outwardly extending end portion, said end portion having two openings therethrough for passage of the terminals therethrough; elastomeric material molded about the bobbin member outer surface and encapsulating the wire coil and lower portions of the terminals, the outer diameter of the molded elastomeric material and the bobbin member extended end portion being sized to fit closely within the recess of the fuel injector housing, whereby insertive support of the actuator assembly in said recess inhibits leakage and therefore contact of fuel with the molded elastomeric material about the coil and lower portions of the terminals.

7. The improved fuel injector of claim 6 in which a close fittings relationship between the pole piece member and the bobbin member inhibits fuel leakage and escape of fuel.

8. The improved fuel injector set forth in claim 6 in which an O-ring seal is located between the central portion of the pole piece member and the bobbin member to seal therebetween.

9. The improved fuel injector set forth in claim 6 in which an O-ring seal is located between the radially extended portion of the bobbin member and the shoulder of the injector housing to seal therebetween.

10. The improved fuel injector set forth in claim 6 in which the openings in the end portion of the pole piece member are sufficiently larger than the outer surface of the terminals to permit a substantial thickness of molded elastomeric material to form therebetween.

* * * * *